United States Patent [19]

Hutcheson

[11] 4,327,464

[45] May 4, 1982

[54] PROCESS OF PRODUCING SIMULATED "BERBER" YARN

[75] Inventor: William F. Hutcheson, Lookout Mountain, Tenn.

[73] Assignee: Rossville Yarn Processing Company, Rossville, Ga.

[21] Appl. No.: 41,183

[22] Filed: May 21, 1979

[51] Int. Cl.[3] ..... B41F 17/38; D02G 1/00; D04B 19/00

[52] U.S. Cl. ..... 28/218; 8/484

[58] Field of Search ..... 28/218; 8/14, 478, 483–487; 101/172

[56] References Cited

U.S. PATENT DOCUMENTS

| | | | |
|---|---|---|---|
| Re. 29,800 | 10/1978 | Gibson et al. . | |
| 790,718 | 5/1905 | Bucher | 8/14 X |
| 2,321,974 | 6/1943 | Bird . | |
| 2,415,320 | 2/1947 | Whittaker et al. . | |
| 3,012,303 | 12/1961 | Whitaker et al. . | |
| 3,102,322 | 9/1963 | Whitaker . | |
| 3,543,359 | 12/1970 | Whitaker . | |
| 3,701,315 | 10/1972 | Maund . | |
| 3,775,054 | 11/1973 | DeVinney | 28/218 X |
| 3,803,880 | 4/1974 | Laing et al. | 28/218 X |
| 3,828,405 | 8/1974 | DeVinney . | |
| 3,948,597 | 4/1976 | Sakaoka . | |
| 3,956,907 | 5/1976 | Murphy et al. . | |
| 3,997,950 | 12/1976 | Gibson . | |
| 4,033,717 | 7/1977 | Whitaker . | |
| 4,045,848 | 9/1977 | Whitaker . | |
| 4,047,405 | 9/1977 | Dombrowski . | |
| 4,086,688 | 5/1978 | Dombrowski . | |
| 4,099,393 | 7/1978 | Norris et al. . | |
| 4,185,364 | 1/1980 | Luckenbach | 28/218 |

FOREIGN PATENT DOCUMENTS

| | | | |
|---|---|---|---|
| 583259 | 9/1933 | Fed. Rep. of Germany | 8/14 |
| 2432261 | 1/1976 | Fed. Rep. of Germany | 28/218 |

*Primary Examiner*—Robert Mackey

*Attorney, Agent, or Firm*—Bell, Seltzer, Park & Gibson

[57] ABSTRACT

Process of producing and a resulting simulated "Berber" yarn produced from long staple spun or continuous filament yarn, preferably having continuous filaments or fibers at least six inches in length, and more preferably continuous filament nylon, to provide strength and other desired characteristics of such yarn while simulating the natural aesthetic appearance of "Berber" wool yarn. The yarn, preferably after having been initially completely dyed with a base color, is surface dyed at selected areas of varying sizes and random locations along the length of the yarn with heather colors or shades which do not penetrate all the way through the yarn for simulating varying staple lengths of natural wool fibers, and is thereafter dyed on small selected areas of the yarn at random locations along the length with one or more "Berber" accent colors which penetrate all the way through the yarn for simulating small clumps of very short natural wool fibers.

11 Claims, 13 Drawing Figures

PROCESS OF PRODUCING SIMULATED "BERBER" YARN

FIELD OF THE INVENTION

This invention is directed to a simulated "Berber" yarn and process of producing same from long staple spun or continuous filament yarn to provide strength, soil resistance, crush resistance, etc., while simulating the natural aesthetic appearance of "Berber" wool yarn having heather colors of fibers of varying staple lengths and "Berber" accent colors of small clumps of natural short wool fibers.

BACKGROUND OF THE INVENTION

Natural "Berber" wool yarns have long been the standard in the carpet, upholstery, apparel, etc., industries for producing high quality woven, knitted, or tufted wool fabrics or carpets having a natural blended heather coloration and "Berber" accent colors.

"Berber" wool yarns and carpets or fabrics produced therefrom date back to a time before Christ when Berber tribesmen in the deserts of North Africa produced fabrics or carpets from hand-made natural wool yarns spun from the normally-occurring varying staple lengths of naturally colored wool fibers of blacks, browns, grays, whites and other similar colors with normally-occurring very short staple length fibers in small clumps of darker colors of blacks and browns. When these fibers were spun into yarns by the Berber tribesmen, a yarn was produced which had a blended effect of the first mentioned colors, which have come to be called "heather" colors, with dots or specks of darker colors, which have come to be called "Berber" accent colors or dots.

In more recent times, "Berber" wool fabric or carpet yarns have been produced in the textile industry utilizing the "woolen system" of producing yarns. In this system, natural wool fibers having staple lengths from about ¼ inch up to about 6 inches and mixed together are carded into slivers and taken directly off of the carding machine to spin yarns from the slivers without subsequent draftings or doublings of the yarns which would cause loss of the very short staple length fibers. The naturally-occurring small clumps of very short staple length fibers, which ultimately produce the "Berber" accent colors or dots in the yarns, must be retained in these "Berber" wool carpet yarns and, therefore, the woolen system of producing yarns is the only system of textile yarn production which is available.

However, due to the high cost of natural wool, these yarns are very expensive and, inasmuch as the resulting yarns include varying and very short staple length fibers, the yarns do not necessarily have desired characteristics from the standpoint of strength, crush resistance, wear resistance, stability, etc.

These latter desired characteristics can be obtained utilizing synthetic yarns, particularly continuous filament yarns and to a lesser degree long cut staple length fiber yarns. As is well known, continuous filament yarns are not separately spun as such but are produced directly out of the spinerette of the extrusion apparatus. On the other hand, long staple synthetic fiber yarns are produced on the "modified worsted system" of yarn production. In this system, long cut staple lengths of synthetic fibers, around 6 to 8½ inches long, are blended, carded, drafted, doubled and then spun to produce yarns. The "modified worsted system" was designed specifically for long cut staple length synthetic yarns and is an off-shoot or modification of the older "worsted system" for wool yarns.

The "worsted system" differs from the "woolen system", discussed above, inasmuch as the wool slivers from the carding machine in the worsted system are combed to remove "noils" or very short staple length fibers to produce what is termed "top" of the longer staple length fibers which are then drafted, doubled and spun to make high quality worsted yarns for apparel fabric and the like.

Neither of these systems, i.e. the "worsted system" for wool or the "modified worsted system" for long cut staple length synthetic fibers, could be utilized to produce "Berber" wool yarns inasmuch as they utilize combing and/or drafting and doubling operations which could not be utilized when it is desired to retain the small clumps of very short staple length wool fibers which provide the "Berber" accent colors or dots which are distinctive to "Berber" wool yarn and carpets produced therefrom.

Attempts to simulate natural "Berber" wool yarns by the use of synthetic fibers have been attempted by others in utilizing acrylic or other synthetic fibers cut into varying staple lengths and stock dyed prior to blending and carding with the heather colors of natural wool and cutting very short staple length fibers to produce small clumps of such fibers which are stock dyed with the "Berber" accent colors and blended in with the other stock dyed fibers to be processed into a yarn on the "woolen system". While acrylic or other synthetic fiber yarns produced in this manner satisfactorily simulate the aesthetic appearance of natural "Berber" wool yarns and are much less expensive since synthetic fibers are cheaper than natural wool fibers, the resulting yarns and fabrics or carpets produced therefrom lack the desired strength and other characteristics of continuous filament or long staple length spun yarns. Additionally, the small clumps of "Berber" accent colored fibers in carpets produced from these types of synthetic yarns will easily come out of the carpet or fabric since they are very short and synthetic fibers do not have the natural kink or curliness of wool fibers and, therefore, do not adhere or are not locked into the wool fibers as would be the case with wool fibers.

It is now well recognized that nylon yarns are the superior synthetic yarns for use in carpet from a strength, soil resistance, crush resistance, etc., standpoint. However, nylon particularly tends to pill or ball up when present in very short cut staple lengths and, therefore, it is unsatisfactory for being utilized in the manner described above for acrylic fibers in producing simulated "Berber" yarns by stock dyeing and producing yarns on the "woolen system". In fact, the Federal Housing Administration will not approve carpets for federally financed housing wherein the carpet yarns have cut staple length spun nylon fibers of less than 6 inches in length.

SUMMARY OF THE INVENTION

Accordingly, it is the object of this invention to provide a process for producing and a resulting simulated "Berber" yarn produced from long staple spun or continuous filament yarn to provide the strength and other characteristics of such yarn while simulating the natural aesthetic appearance of "Berber" wool yarns.

It is a further more specific object of this invention to provide a process for producing and a resulting simulated "Berber" yarn, as set forth in the above object, in which the yarn is constructed of continuous filament nylon for producing the ultimate desirable carpet yarn having maximum strength, soil resistance, crush resistance, etc.

By this invention, it has been discovered that the above object may be accomplished by a process comprising the steps of providing a yarn consisting of continuous filaments or long staple spun fibers, preferably at least 6 inches in length, surface dyeing selected areas of varying sizes and random locations along the length of the yarn with heather colors or shades while limiting penetration of the heather colors to the surface areas only without penetrating all the way through the yarn for simulating varying staple lengths of natural wool fibers, and dyeing small selected areas of the yarn at random locations along the length of the yarn with one or more "Berber" accent colors which penetrate all the way through the yarn for simulating short clumps of natural wool fibers. Preferably, the yarn is initially dyed with a base color prior to the steps of dyeing with the heather colors and "Berber" accent color. The process is preferably performed on yarns comprising continuous filament nylon.

It has been further discovered by this invention that the above steps of heather color dyeing and "Berber" accent color dyeing on the yarn can best be accomplished by producing from the yarns a flat prefabric having front and back surfaces, preferably by knitting a flat knit prefabric or possibly by weaving a prefabric. The prefabric is then dyed at selected areas on the front and back faces with one or more heather colors or shades while limiting the penetration of the heather dye colors to the surface area only of the yarn in the prefabric so that the heather dye colors do not penetrate all the way through the yarns. The prefabric is then dyed at small selected areas thereof with one or more "Berber" accent colors while causing penetration of the "Berber" accent colors all the way through the yarns.

These dyeing operations are preferably performed by the use of roller printing apparatus having engraved areas therein wherein the engraved roller applying the heather colors utilizes shallow engravings of a predetermined depth to contain a desired amount of dye which will only dye the surface of the yarn in the selected areas of the prefabric without penetrating all the way through the yarn, while the engraved roller utilized for the "Berber" accent color utilizes engraved areas of sufficient depth to contain a desired amount of dye for application to the selected areas of the prefabric for penetrating all the way through the yarn therein.

Thereafter, the prefabric is raveled to produce the novel simulated "Berber" yarns described above.

PRIOR ART

By way of additional background, a process is well known in the textile industry which is termed the "knit-de-knit" process for "space dyeing" yarns to produce randomly dyed yarns. This process was developed to simulate in a single yarn end what was previously accomplished by plying two or more yarns of different colors together to obtain a plied "tweed" or "moresque" yarn. The following exemplary U.S. Patents disclose various adaptations of the "knit-de-knit" and "space dyeing" processes for dyeing of yarns to simulate plied "tweed" or "moresque" yarns:

| U.S. Pat. No. | Inventor | Issue Date |
|---|---|---|
| 3,012,303 | Whitaker et al | Dec. 12, 1961 |
| 3,102,322 | Whitaker | Sept. 3, 1963 |
| 3,543,359 | Whitaker | Dec. 1, 1970 |
| 3,701,315 | Maund | Oct. 31, 1972 |
| 3,828,405 | DeVinney | Aug. 13, 1974 |
| 3,956,907 | Murphy et al | May 18, 1976 |
| 4,033,717 | Whitaker | July 5, 1977 |
| 4,045,848 | Whitaker | Sept. 6, 1977 |
| 4,047,405 | Dombrowski | Sept. 13, 1977 |
| 4,086,688 | Dombrowski | May 2, 1978 |

In addition, it has been previously suggested to use a "weave-de-weave" process for generally the same purpose, as may be seen in the following exemplary patents:

| U.S. Pat. No. | Inventor | Issue Date |
|---|---|---|
| 3,997,950 | Gibson | Dec. 21, 1976 |
| Re. 29,800 | Gibson et al | Oct. 17, 1978 |

These processes may also involve the use of roller printing apparatus for such "space dyeing".

However, as may be seen from these patents and as is commonly known in the textile industry, the "knit-de-knit", "weave-de-weave" and "space dyeing" processes involve dyeing of localized selected areas of the prefabric so that the dye color penetrates all the way through the yarn and through the prefabric so that the colors applied to the localized selected areas penetrate all the way through the yarns to simulate the distinctive, random, individual coloration which would be produced by plying two or more ends of different colored yarns to produce a "tweed" or "moresque" yarn. Indeed, it is the more common practice in the industry for the "knit-de-knit" process to utilize a prefabric consisting of a tubular knit prefabric inasmuch as the dye colors applied to selected localized areas of the prefabric on the outside face thereof will penetrate all the way through the prefabric to the inside face which would not come in contact with the engraved dyeing roller.

Therefore, all of the engraved rollers used in the above-described processes contain engraved areas of sufficient depth to contain a predetermined amount of dye to penetrate all the way through the yarns and through the prefabric.

From the above explanation, it may be clearly seen that the "knit-de-knit", "weave-de-weave" and "space dyeing" processes have not heretofore been utilized or have not been conceived as being adaptable for producing the novel simulated "Berber" yarns of this invention having a migrated heather coloration with accent dots and, indeed, the purpose of these processes and the yarns produced thereby having random distinctive coloration simulating plied yarns of different colors would lead one in the textile industry away from the use of these processes for the purposes utilized in this invention.

In addition to the above, roller printing of textiles by engraved rollers has been utilized for printing of sheets, apparel and other types of fabrics wherein a desired pattern of coloring is desired on the face surface of the textile fabric, but is not necessary on the back or other surface of the textile fabric. In these processes, engraved rollers having shallow engraved areas thereon sufficient to contain a desired amount of dye for coloring only the surface of the textile fabric and not to penetrate all the way through the fabric have been used. However, to applicant's knowledge, this shallow engraved roller printing process has not heretofore been utilized on yarns per se or on prefabrics which are to be raveled to produce yarns, let alone to produce the novel simulated "Berber" yarns of the present invention. Indeed, the applications of these shallow engraved roller printing operations in the textile industry were for purposes totally remote from that of the present invention.

Accordingly, this invention has, for the first time, conceived and satisfactorily produced simulated "Berber" yarn from long staple spun or continuous filament yarn, preferably continuous filament nylon, to provide strength and other desired characteristics of such synthetic yarn while simulating the natural aesthetic appearance of "Berber" wool yarn. While this novel construction of yarn may be produced in other ways, as will be pointed out in the detailed description of a specific example to follow, it is preferably produced by the "knit-de-knit" process and the "space dyeing" process utilizing modified roller printing apparatus. While the "knit-de-knit" process, the "space dyeing" process and roller dye printing apparatus have been utilized in the textile industry for other purposes, they have not been utilized in the manner conceived by the process of this invention for producing the novel construction of yarn of this invention and their conventional uses in the textile industry would not lead one to conceive their uses in the manner set forth in this invention.

BRIEF DESCRIPTION OF DRAWINGS

Some of the objects and advantages of this invention having been set forth, other objects and advantages will appear as the description proceeds when taken in conjunction with the accompanying drawings, in which.

DETAILED DESCRIPTION OF EXEMPLARY PROCESS AND YARN OF THE INVENTION

Figure 1:
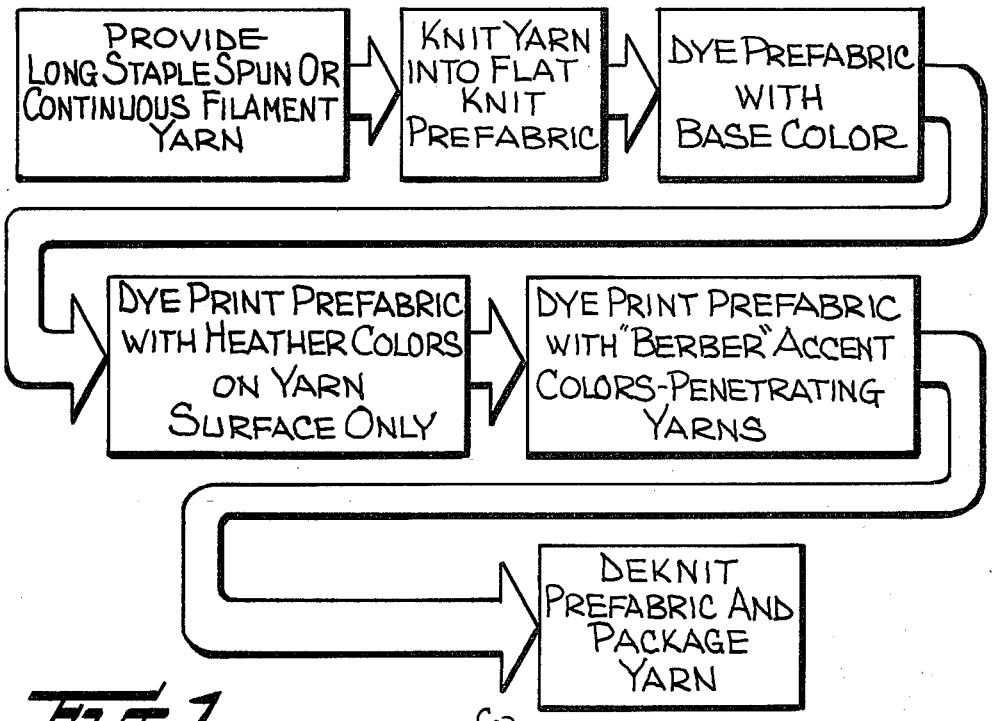
FIG. 1 is a flow diagram illustrating the preferred steps of the process of this invention.

A summary of the process and resulting yarn product of this invention in its broadest terms has been set forth above and will not be repeated in this detailed description. For convenient reference, a flow diagram of the broad process of this invention, with some preferred steps added, is illustrated in FIG. 1.

In FIGS. 2–13, one example of processing yarn and the yarn product resulting therefrom has been illustrated and will be described below; however, it is to be understood that variations in the illustrated exemplary process and resulting yarn product can be effected in accordance with the broad description of the process and resulting yarn product of this invention set forth above and the specifically illustrated exemplary process and resulting yarn product is not intended to limit the scope of this invention.

Although not specifically illustrated in FIGS. 2–13, yarn 10 is initially provided consisting of long staple spun fibers or continuous filaments. In order to obtain the desired characteristics of strength, soil resistance, crush resistance, etc., the fibers or filaments of the yarn 10 should preferably be continuous filaments or fibers at least six inches in length and could either be natural or synthetic fibers or filaments; however, synthetic fibers or filaments are preferred and continuous filament nylon is particularly preferred when the yarn 10 processed in accordance with this invention is to be utilized as carpet yarn.

The yarn 10 is knit into a prefabric 20, which may be done on a flat bed knitting machine that produces a one and one or plane rib flat knit strip composed of one or more continuous ends or on other knitting machines for producing other knit constructions. As has been mentioned above, it is not believed that a tubular knit fabric, which is the more conventional prefabric heretofore utilized in known commercial "knit-de-knit" and "space dyeing" processes could be utilized in the present process inasmuch as surface dyeing of the yarns 10 and the prefabric 20 is desired on each face of the prefabric, as will be discussed in more detail below.

Other alternatives to a knit prefabric could include a woven prefabric, as mentioned above, or the provision of a series of warp yarns for printing thereof as is well known to those with ordinary skill in the art in the textile industry as "warp printing".

Figure 2:
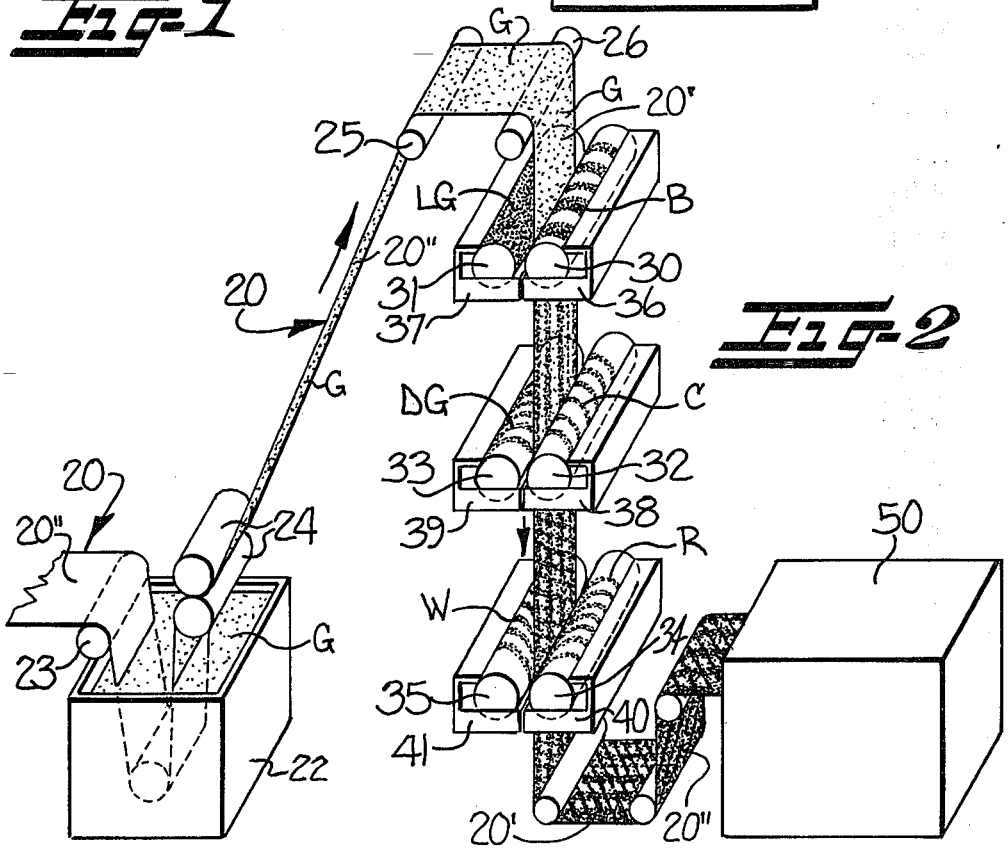
FIG. 2 is a schematic view illustrating one example of dyeing steps which may be utilized in the process of this invention.

Referring now to FIG. 2 for exemplary steps of dyeing of the yarn 10, the knitted prefabric 20 is fed into a dye bath tank 22 over guide roll 23 and through a bath of solid gold dye G within the tank 22 for dyeing all of the yarns 10 in the prefabric 20 to a solid gold base color G which dye color penetrates all the way through the yarns 10. This base color dyeing step is not essential in the process of this invention and the yarns 10 could be left their natural color which could be utilized as the base color.

From the dye bath tank 22, the prefabric 20 is fed through a pair of squeeze rolls 24 over guide rolls 25, 26. From these guide rolls 25, 26, the prefabric 10 dyed with a base gold color G is fed through a series of pairs of printing rollers 30, 31, 32, 33, 34, 35 in which the printing rollers 30, 32, 34 print one face 20' of the prefabric 20 and the printing rollers 31, 33, 35 print the other face 20'' of the prefabric 20. Each of these printing rollers includes engraved areas on the surface thereof in a predetermined pattern consisting of contiguous small engraved cups or cells which pick up dye from individual dye tanks 36, 37, 38, 39, 40, 41, respectively as the rollers move through the dye baths within the dye tanks. Surplus dye on the roller areas not engraved is removed and returned to the respective dye tanks by doctor blades forming a part of the respective dye tanks, as illustrated in FIG. 2. The dye remaining in the engraved cups of each engraved area of each of the printing rollers is printed onto the knitted prefabric in the predetermined designed pattern with desired controlled degrees of penetration, i.e. surface only for the heather colors and complete penetration for the "Berber" accent colors.

In accordance with this invention, it has been determined that the depth of the engraved cups or cells combined with the dye bath preparation regarding ratios of dyestuff to water, etc., for controlling viscosity determines the depth of penetration of the dye into the yarn 10. The number of cups or cells per square inch and the depth of engraved cups can be increased or decreased depending on the effect desired in the finish yarn 10.

Figure 3:
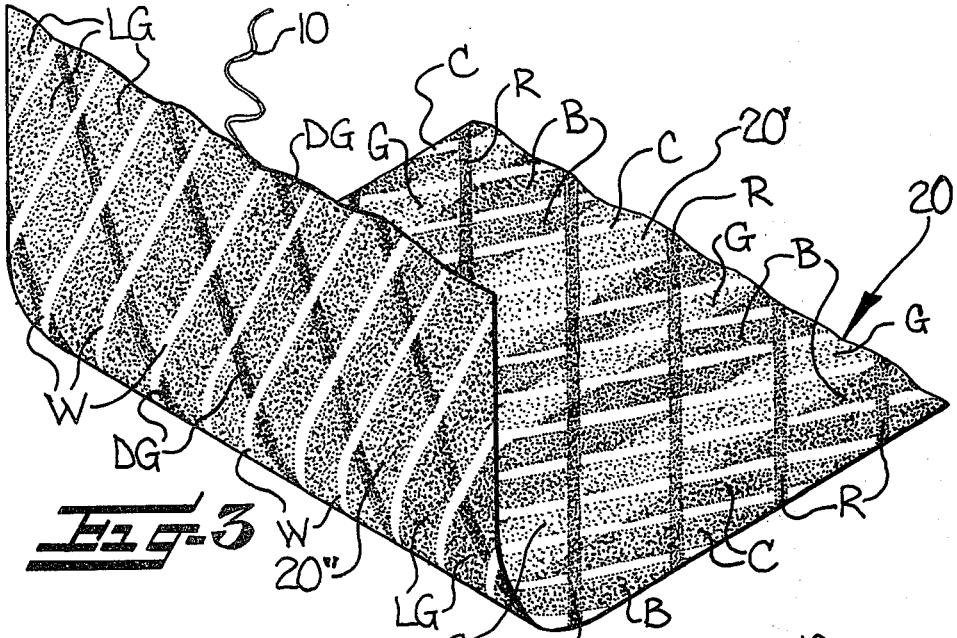
FIG. 3 is a schematic view of the prefabric dyed in accordance with FIG. 2.
Figure 4:
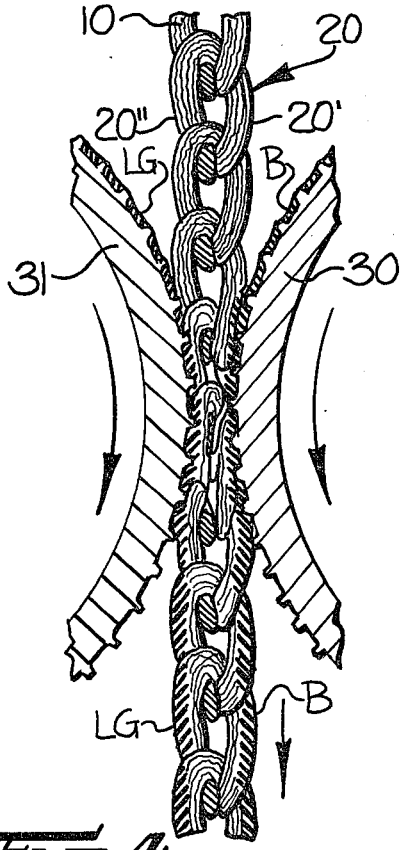
FIG. 4 is a partial sectional view taken through the prefabric and top two dye rollers illustrated in FIG. 2.

As may be seen particularly in FIGS. 2 and 3, the face 20' of the prefabric 20 is first printed by the roller printer 30 with a heather beige dye color B in the form of generally longitudinally extending stripes indicated in FIGS. 2 and 3. As may be seen also in FIGS. 4, 9 and 12, the engraved cups of the engraved areas of the printing roller 30 are sufficiently shallow to only contain an amount of dye for dyeing the surface of the yarns 10 on the face 20' of the prefabric 20 and not allow penetration of the beige dye color B all the way through the yarns 10. For example, each square inch of the engraved area may contain 36 cells or cups with a very shallow depth of 0.0075 inches with the cell or cup walls made as thick as possible.

Simultaneously with the printing of the heather beige color B on the face 20' of the prefabric 20, the printing roller 31 will be printing the other face 20'' of the prefabric 20 with a heather light gray color LG. As may be seen in FIGS. 2 and 3, the printing roller 31 has its entire printing surface engraved so that the entire surface of the face 20'' of the prefabric 20 will be printed with the heather light gray color LG. As may be seen in FIG. 4, the depth of the engraved cups in the engraved surface of the printing roller 31 are similar to that of the printing roller 30 so as to only contain an amount of dye for dyeing the surface of the yarns 10 on the face 20'' of the prefabric 20 and not allow penetration of the heather light gray color LG all the way through the yarns 10. The number of cells or cups per square inch and the depth of such cups may be the same as set forth above with respect to the printing roller 30.

Figure 13:
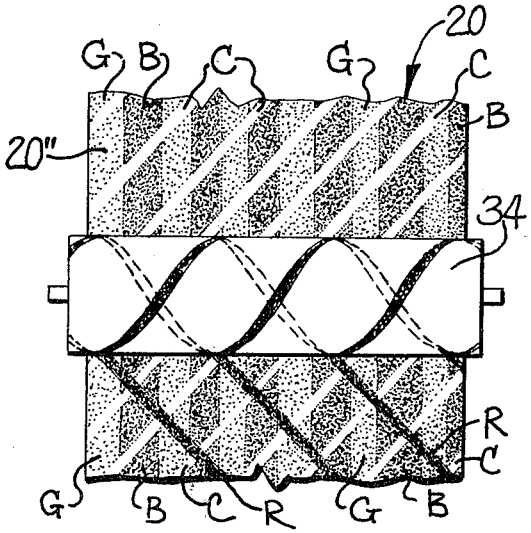
FIG. 13 is a view, like FIG. 12, of the bottom right-hand dye roller of FIG. 2 illustrating its application of dye onto the prefabric.

Next, the prefabric 20 passes between the pair of printing rollers 32, 33 wherein the face 20' of the prefabric 20 is printed by the printing roller 32 with a heather cream color C in the form of diagonally extending narrow stripes as indicated in FIGS. 2 and 13. As may be seen in FIG. 5, the engraved cups of the engraved area of the printing roller 32 are sufficiently shallow to only contain an amount of dye for dyeing the surface of the yarns 10 on the face 20' of the prefabric 20 and not allow penetration of the heather cream color C all the way through the yarns 10. The number of cups per square inch in the engraved area and the depth of such cups may be the same as that set forth above with respect to the printing roller 30.

Figure 5:
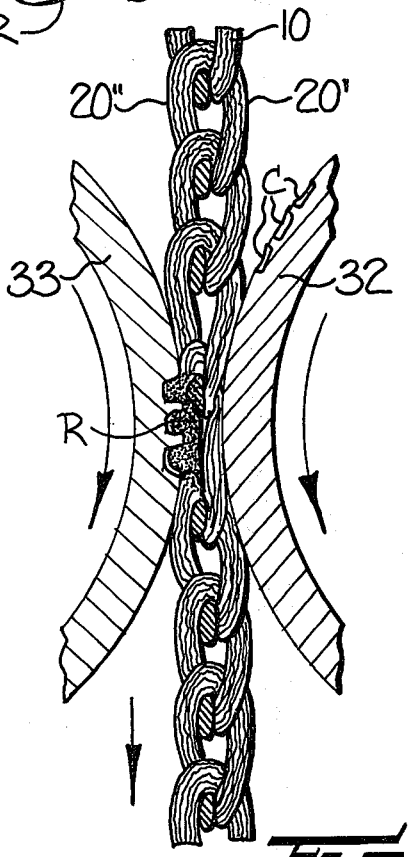
FIG. 5 is a view like FIG. 4 taken through the prefabric and middle two dye rollers of FIG. 2.
Figure 7:
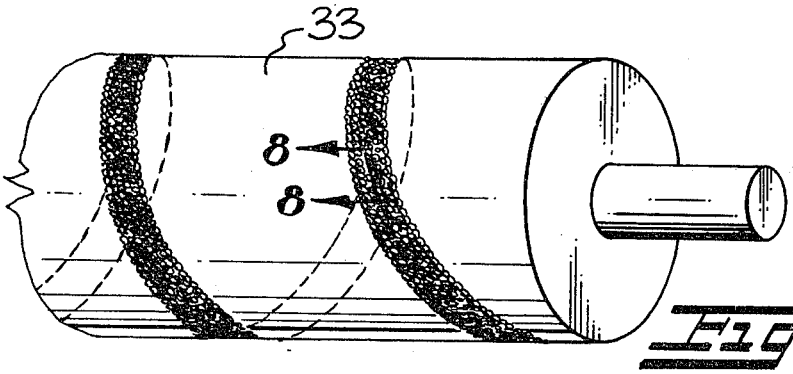
FIG. 7 is a partial, enlarged, perspective view of the dye roller utilized on the left-hand side of the middle pair of dye rollers of FIG. 2.
Figure 8:
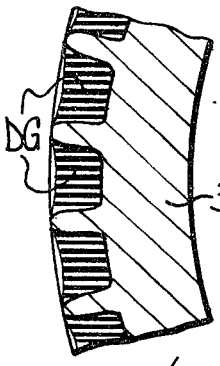
FIG. 8 is an enlarged, partial, sectional detail taken generally along the line 8—8 of FIG. 7.
Figure 9:
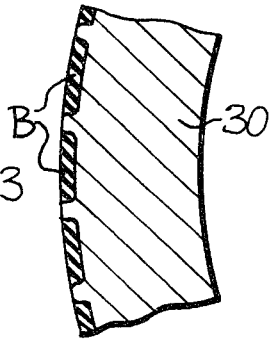
FIG. 9 is a view, like FIG. 8, taken along the line 9—9 of FIG. 12.

Simultaneously, the printing roller 33 is printing a "Berber" accent dark gray color DG onto the face 20'' of the prefabric 20 in the form of diagonal stripes as indicated in FIG. 3. It is desired that this "Berber" accent dark gray color DG penetrate at least all the way through the yarns 10 on the face 20'' of the prefabric 20 and, therefore, the depth of the engraved cups in the engraved area of the surface of the printing roller 33, as indicated in FIGS. 5, 7 and 8, is deeper than those heretofore described so that a sufficient amount of dark gray color DG may be picked up in each engraved area for application to the face 20'' of the prefabric 20 for penetration all the way through the yarns 10 on such face. On this printing roller 33, the distance between engraved cups may be 0.015 inches and the depth of each may range between 0.015 to 0.025 inches.

Next, the prefabric 20 passes between printing rollers 34, 35. The printing roller 34 prints the face 20' of the prefabric 20 with a "Berber" accent rust color R in the form of diagonally extending stripes which may be somewhat wider than the diagonally extending cream stripes C, as indicated in FIGS. 2, 3 and 13. The engraved cups of the engraved surface of the printing roller 34 are similar to that described above with respect to the printing roller 33 so as to have sufficient depth for containing a sufficient amount of rust color R for at least penetrating all the way through the yarns 10 on the face 20' of the prefabric 20.

Simultaneously, the printing roller 35 is printing the other face 20'' of the prefabric 20 with a heather white cream color W in the form of diagonal stripes which may be somewhat narrower than the "Berber" accent dark gray stripes DG printed by the printing roller 33, as indicated in FIG. 3. It is desired that this heather white cream color W be printed on the surface only of the yarns 10 on the face 20'' of the prefabric 20 and, therefore, the depth of the engraved cups in the engraved area on the surface of the printing roller 35 would be similar to that described above with respect to the printing rollers 30, 31 and 32 to contain only a sufficient amount of heather white cream color W not to penetrate all the way through the yarns 10.

After the prefabric 20 is printed, as described above, the prefabric 20 may pass through a steaming mechanism for setting the dyestuff and then through rinse tanks and drying apparatus, as indicated schematically at 50 in FIG. 2.

The resulting base dyed and printed prefabric with heather color surface printing and "Berber" accent color printing penetrating through the yarns 10 is shown in FIG. 3. However, it is to be understood that an infinite number of combinations of such base color, heather surface colors and "Berber" accent penetrating colors could be utilized in accordance with this invention and the above-described and illustrated exemplary process is not intended to limit the scope of this invention. Additionally, heather colors could be printed onto the prefabric which penetrate all the way through the yarns, in addition to the essential surface heather color printing for producing further variations in the resulting effect. Additionally, other printing systems which do not utilize engraved printing rollers might be used, such as rubber roll with controlled doctor blade settings, furnisher rolls where the amount of dye placed on the rolls is controlled, etc.

Figure 6:
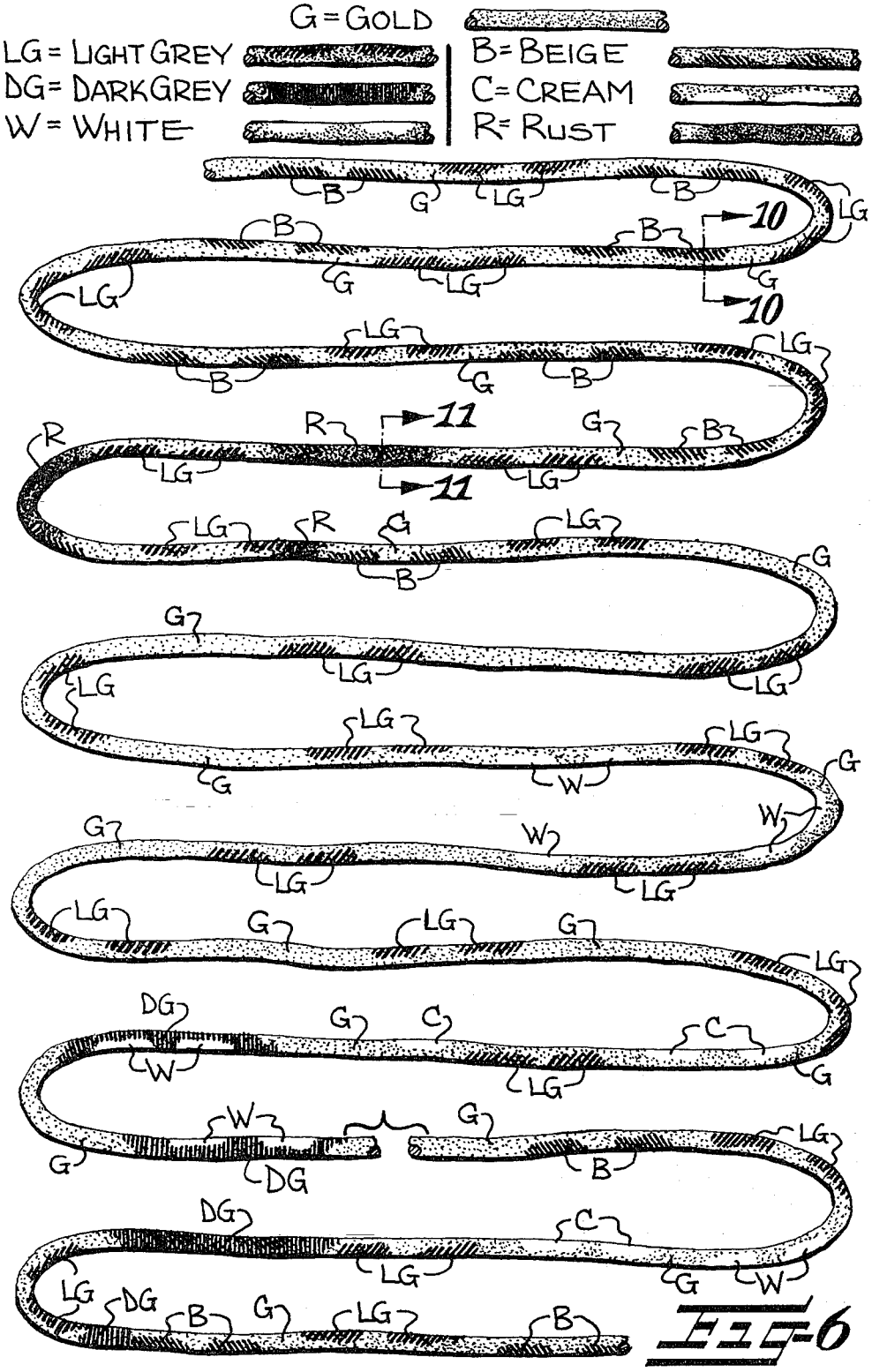
FIG. 6 is a schematic view of yarn after it has been raveled from the prefabric of FIG. 3 and with a legend as to color shading at the top of the view.
Figure 10:
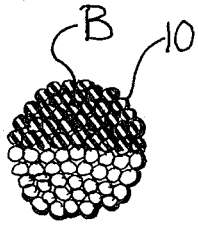
FIG. 10 is an enlarged, sectional view taken generally along the line 10—10 through the yarn of FIG. 6.
Figure 11:
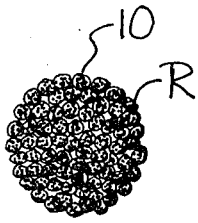
FIG. 11 is an enlarged, sectional view taken generally along the line 11—11 through the yarn of FIG. 6.
Figure 12:
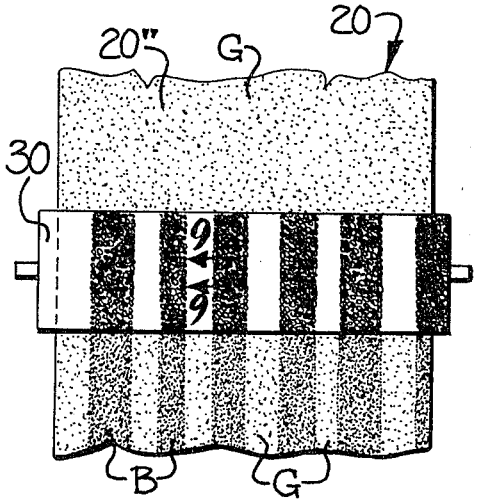
FIG. 12 is a side elevational view of the top right-hand dye roller of FIG. 2 illustrating the application of dye onto the prefabric.

Next, the prefabric 20 is raveled to de-knit the prefabric and form individual yarns 10, as illustrated in FIG. 6, which would include a base gold color G penetrating through and initially completely covering the yarn 10, heather beige B, light gray LG, cream C and white cream W colors dyed on surface areas only of the yarn 10 and which do not penetrate all the way through the yarn 10, as illustrated also in FIG. 10, and which are randomly located and of varying sizes along the length of the yarn 10 to simulate varying staple lengths of natural wool fibers, and "Berber" accent dark gray DG and rust R colors dyed on random portions of the yarn 10 along its length which penetrate all the way through the yarn 10, as illustrated also in FIG. 11, to simulate short clumps of natural wool fibers. The illustration of the yarn 10, in FIG. 6, dyed as discussed above, is necessarily schematic and the actual appearance of any given yarn produced in accordance with this invention would vary from that illustrated in FIG. 6.

The resulting simulated "Berber" yarn 10 could be utilized in singles or in plies such as a two-ply or three-ply yarn, and could be additionally cabled to double the plies, all of which would accentuate the heather look.

In the drawings and specification there has been set forth a broad description and specific examples of the process and resulting yarn of this invention, and although specific terms are employed, they are used in a descriptive sense only and not for purposes of limitation.

What I claim is:

1. A process for producing a yarn having an appearance simulating the natural aesthetic appearance of "Berber" wool yarns, said process comprising the steps of:

forming at least one yarn into a flat prefabric having front and back surfaces;

applying to selected areas of both the front and back surfaces of the prefabric, at least one heather color dye while limiting the penetration thereof to the surface area only of the portions of the yarn located at the surface of the prefabric so that the heather color dye does not penetrate through the yarn but forms random size heather colors of varying lengths on various surface portions of the yarn;

applying to selected areas of at least one surface of the prefabric, at least one accent color dye while causing penetration thereof through the yarn to form short areas of the accent color at random locations along the yarn; and raveling the prefabric to thus obtain a yarn therefrom having a simulated "Berber" yarn appearance characterized by having random size heather colors of varying lengths on surface portions only of the yarn for simulating varying staple lengths of natural wool fibers and having at least one "Berber" accent color which penetrates through the yarn at random locations along its length for simulating short clumps of natural wool fibers.

2. A process as set forth in claim 1 including the further step, performed prior to applying said heather and accent color dyes to the prefabric, of dyeing the prefabric and and all of the yarns therein a predetermined base color.

3. A process as set forth in claim 1 wherein said step of applying at least one accent color dye to selected areas of the prefabric comprises applying said at least one accent color dye in selected areas of considerably smaller size than the selected areas of the fabric to which said at least one heather color dye is applied.

4. A process as set forth in claim 1 wherein said step of applying at least one heather color dye to selected areas of both the front and back surfaces of the prefabric comprises applying one heather color dye over substantially all of one of said surfaces of the prefabric and applying at least one contrasting heather color dye to selected portions only of the opposite surface of the prefabric.

5. A process as set forth in claim 1 wherein said step of forming at least one yarn into a flat prefabric comprises forming the prefabric from continuous filament yarn.

6. A process as set forth in claim 1 wherein said step of forming at least one yarn into a flat prefabric comprises forming the prefabric from long staple spun yarn.

7. A process as set forth in claim 1 wherein said step of forming at least one yarn into a flat prefabric comprises knitting a flat knit fabric.

8. A process as set forth in claim 1 wherein the step of applying at least one heather color dye to both the front and back surfaces of the prefabric comprises contacting the front and back surfaces of the prefabric with respective print rollers having shallow engravings therein of a predetermined depth to contain a limited amount of dye which will only dye the surface of the yarn in the selected areas of the prefabric without penetrating all the way through the yarn.

9. A process as set forth in claim 1 wherein said step of applying at least one accent color dye to selected areas of at least one surface of the prefabric comprises contacting at least one surface of the fabric with a print roller having engraved areas therein of such depth as to contain an amount of dye sufficient for penetrating all the way through the yarn in the selected areas of the prefabric.

10. A process for producing a yarn having an appearance simulating the natural aesthetic appearance of "Berber" wool yarns, said process comprising the steps of:

knitting at least one continuous multifilament nylon yarn into a flat knit prefabric having front and back surfaces;

dyeing the knitted prefabric and all of the yarns therein a base color;

applying to selected areas of both the front and back surfaces of the prefabric, at least one heather color dye while limiting the penetration thereof to the surface area only of the portions of the yarn located at the surface of the prefabric so that the heather color dye does not penetrate through the yarn but forms random size heather colors of varying lengths on various surface portions of the yarn;

applying to selected areas of at least one surface of the prefabric, at least one accent color dye while causing penetration thereof through the yarn to form short areas of the accent color at random locations along the yarn; and raveling the prefabric to thus obtain a yarn therefrom having a simulated "Berber" yarn appearance characterized by having random size heather colors of varying lengths on various surfaces of the yarn for simulating varying staple lengths of natural wool fibers and having at least one "Berber" accent color which penetrates through the yarn at random locations along its length for simulating short clumps of natural wool fibers.

11. A process for producing a yarn having an appearance simulating the natural aesthetic appearance of "Berber" wool yarns, said process comprising the steps of:

knitting at least one yarn into a flat knit prefabric;

dyeing the knitted prefabric and all of the yarns therein a base color;

applying over substantially all of one of the surfaces of the prefabric a heather color dye while limiting the penetration thereof to the surface area only of the portions of the yarn located at the surface of the prefabric so that the heather color dye does not penetrate through the yarn but forms random size heather colors of varying lengths on various surface portions of the yarn; applying to selected portions only of at least the other surface of the prefabric at least one contrasting additional heather color dye while limiting the penetration thereof to the surface area only of the portions of the prefabric so that such additional heather color dye does not penetrate through the yarn but forms random size heather colors of varying lengths on various surface portions of the yarn;

applying to at least one surface of the prefabric, in selected areas of considerably smaller size than the selected areas of the fabric to which said at least one additional heather color dye is applied, at least one accent color dye while causing penetration thereof through the yarn to form short areas of the accent color at random locations along the yarn; and raveling the prefabric to thus obtain a yarn therefrom having a simulated "Berber" yarn appearance characterized by having random size heather colors of varying lengths on various surfaces of the yarn for simulating varying staple lengths of natural wool fibers and having at least one "Berber" accent color which penetrates through the yarn at random locations along its length for simulating short clumps of natural wool fibers.

* * * * *